United States Patent [19]

Kaneko

[11] 4,390,047

[45] Jun. 28, 1983

[54] TOOL FOR STRAP TENSIONING AND CUTTING

[76] Inventor: Hogara Kaneko, 3-2-302, Zengyo Danchi, Fujisawa City, Japan

[21] Appl. No.: 185,780

[22] Filed: Sep. 11, 1980

[30] Foreign Application Priority Data

Sep. 29, 1979 [JP] Japan ..... 54-125509

[51] Int. Cl.[3] ..... B21F 9/02

[52] U.S. Cl. ..... 140/93.2; 140/123.6

[58] Field of Search ..... 140/93 A, 93.2, 123.6

[56] References Cited

U.S. PATENT DOCUMENTS

| | | | |
|---|---|---|---|
| 3,782,426 | 1/1974 | Morgan et al. | 140/123.6 |
| 3,830,263 | 8/1974 | Benfer | 140/93.2 |
| 4,081,002 | 3/1978 | Violi | 140/93.2 X |
| 4,093,005 | 6/1978 | Eberhardt et al. | 140/93.2 X |

*Primary Examiner*—Howard N. Goldberg
*Assistant Examiner*—Fred A. Silverberg
*Attorney, Agent, or Firm*—Holman & Stern

[57] ABSTRACT

A tool for tensioning a bundle strap about a bundle of wires and then cutting the strap, wherein the degree of tensioning is adjustable.

5 Claims, 7 Drawing Figures

TOOL FOR STRAP TENSIONING AND CUTTING

BACKGROUND OF THE INVENTION

This invention relates to a cutter for cutting a strap for bundling electric cables and the like after the strap has been fastened around the bundle.

SUMMARY OF THE INVENTION

This invention relates to a cutter for cutting a strap for bundling electric cables and the like, said cutter comprising a trigger fitted to a body having a grip formed integral with the body, a mechanism for nipping the binding strap provided at the head of a sliding plate cooperating with the trigger, a cutter plate having a cutting edge disposed to be movable up and down just short of the strap inserting slit of a medium plate, said cutter plate being capable of successively fastening and cutting the strap bound around a bundle of electric cables and the like as the trigger is pulled.

BRIEF DESCRIPTION OF THE DRAWINGS

The accompanying drawings show one preferred embodiment of a cutter according to the present invention for cutting a strap for bundling electric cables and the like said cutter being capable of optionally adjusting the binding tightness of the strap, wherein.

DETAILED DESCRIPTION OF THE INVENTION

Figure 1:
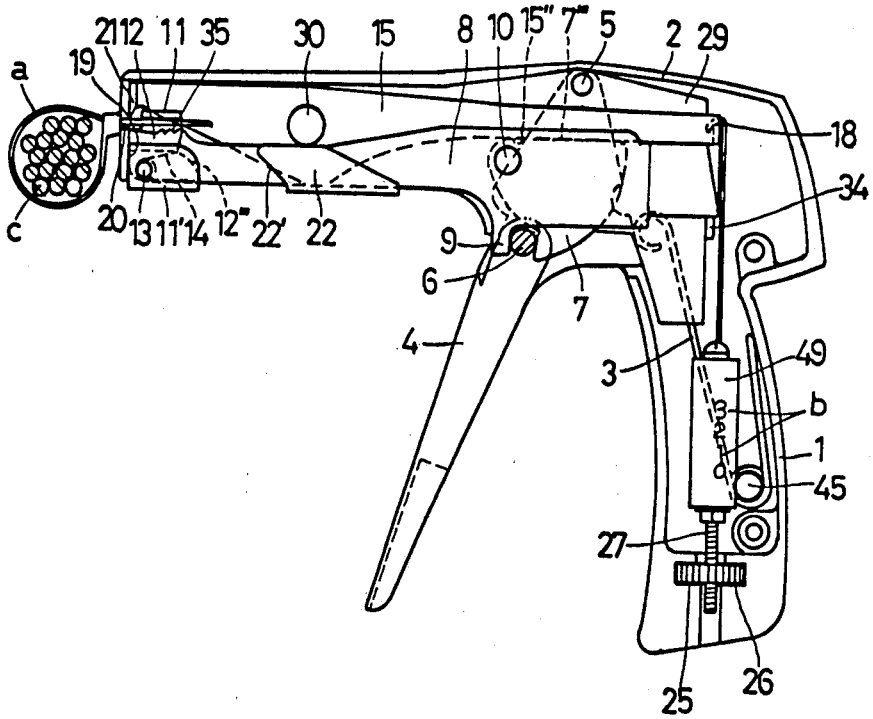
FIG. 1 shows a side view of the cutter with its grip cover removed.

This invention relates to a cutter for cutting a strap bound around electric cables, wires, rods, and the like and more particularly to a strap cutter capable of optionally adjusting the fastening tightness of the strap.

An object of the present invention is to provide a cutter that is able to adjust at will the fastening tightness of the strap and is certain to rapidly cut the strap.

It is another object of the present invention to provide a strap cutter which is certain to perform the binding and cutting operation rapidly.

An embodiment of a tool for cutting a strap for binding electric cables and the like according to this invention will be described hereinafter with reference to the accompanying drawings.

In the drawings, reference numeral 1 denotes a grip, and the grip and the body 2 integral with the grip are formed hollow to contain all the mechanisms therein. a handle 4 is pivoted to the body 2 through its top end hole 44 mounted on a journal 5 through the hole 32 of a medium plate 29. An actuator member 7 is engaged with a pin 6 extended through the intermediate portion of the handle 4, said actuator member being provided with an abutment 7' and in the actuator member there is formed also a hole 7'' into which is inserted a pin 10, which pin is also inserted into the hole 43 of a sliding plate 8 the downward projection 9 of which is arranged to contact with the actuator member 7, said pin 10 being attached to the body 2.

At the forward end of the sliding plate 8 there is formed a hole 37, and a pin 13 is inserted into the hole 37 and the hole 36 of a nipping member 12 having nipping teeth 35 in order to pivotably attach the nipping piece 12 under the bent hook 11 of the sliding plate 8. A formed wire spring 14 is inserted into the slit 12' of the nipping member 12 to actuate the same. There is also provided a cutter plate 15 with its intermediate portion journalled to the body 2 along with the sliding plate 8.

On the holding notch 15' at the rearmost of the cutter plate 15 there is hung an adjusting member 17 with its top end hook 18 engaged with the notch 15' under the action of a helical spring 16, said adjusting member 17 being provided with a screw shaft 27 having a rotary female screw 26. Just short of a strap insertion slit 20 formed in the bent part 19 of the medium plate 29 provided along the body 2 there is disposed a cutter edge 21 of the cutter plate 15 so as to be movable up and down.

On the medium plate 29 there is formed a rest cam 22 having an edge 22' to which is to be abutted the curved face 12''' of the nipping member 12. The cutter plate 15 with its hole 40 provided on its intermediate portion, the medium plate 29 with the hole 31, and the body 2 with its hole 39 are assembled together by means of a pin 30 inserted through their holes 40, 31 and 39 respectively, the second formed wire spring 3 serving to push the formost face 12'' of the nipping member 12 against the bent part 19 of the medium plate 29.

To the body 2 is applied a grip cover 23 while in the medium plate 29 there is formed an aperture 33 for receiving a pin and on the rear vertical side thereof there is provided a bent tab 34 which receives and guides the sliding plate 8 by the bottom edge 8'' formed on the rear end portion 8' of the plate 8, said plate 8 being received on said bent tab against the depressing direction of the spring 16.

The cutter plate 15 is disposed to be abutted by an abutment member 7' with its slant bottom edge 15'' contacted with the upper edge 7''' of the actuator member 7.

Adjusting member 17 is covered by the grip 1 and the grip cover 23 covering the grip, and the screw shaft 27 of the adjusting member 17 is screwed into the rotary female screw member 26 a part of which being designed to project outwardly from the apertures 24 and 25 provided respectively in the grip 1 and grip cover 23, and an index plate 49 showing adjusting figures b disposed to be seen through the aperture 28 formed in the grip cover 23 is additionally attached to the shaft, the entire adjusting member being movable up and down by the rotation of the screw member 26 so as to change the tensioning degree of the cutter plate 15 tensioned by the helical spring 16, its adjusted amount being shown by means of the adjusting figures b through the aperture 28 so that the degree of fastening tightness of the electric cables and the like may be adjusted.

In the drawings, 37 and 38 are pin-holes for the pin 13, said pin-hole 38 being formed in the bent portion 11' of the sliding plate 8. A washer 41 is disposed about the neck portion 30' of the pin 30 to ensure that the pin 30 is secured. There is also a washer 42 disposed about the neck portion 6' of the pin 6 to secure it as well as the handle 4, said pin being inserted through the holes formed respectively in the handle 4 and the actuator member 7, 45 is the projection for receiving the annular portion 3' of the formed wire spring 3; 46, 46' and 46'' are screws to be screwed into the female screw holes (not shown) of the grip cover 23 through holes 47, 47' and 47″ formed in the grip 1 for securing the grip cover 23, and 48 is a guide groove for the screw shaft 27.

Now, the performance of the present invention will be explained as follows.

Figure 2:
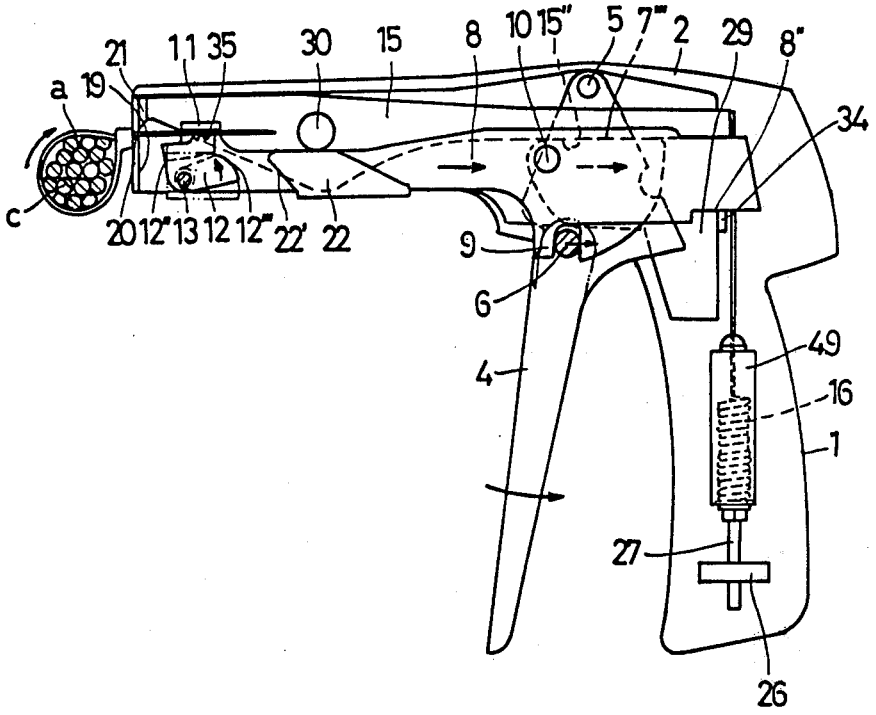
FIGS. 2 to 4 are side views showing an operational sequence of the cutter.
Figure 3:
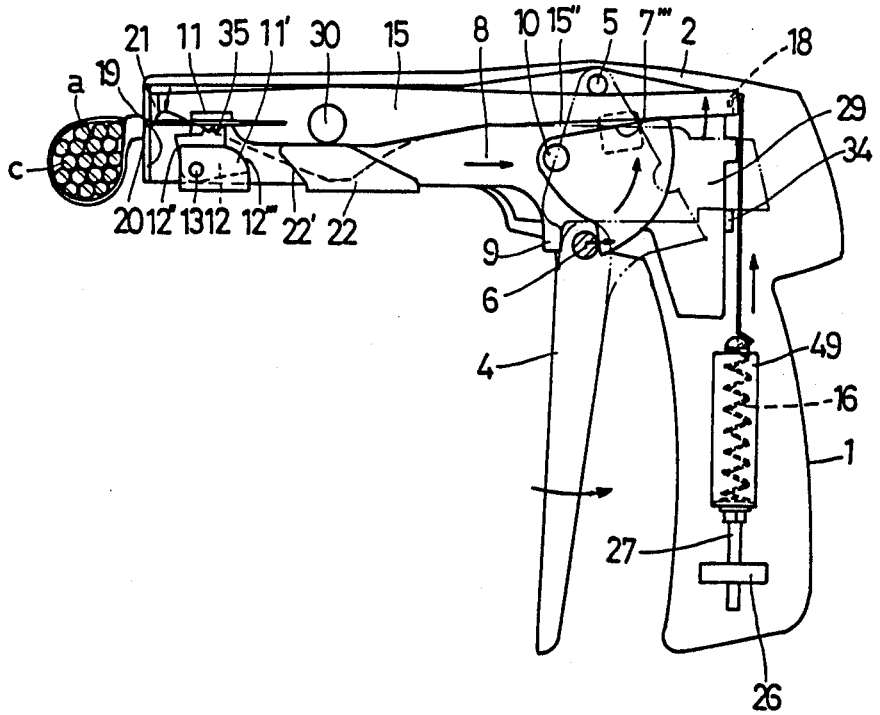
Figure 4:
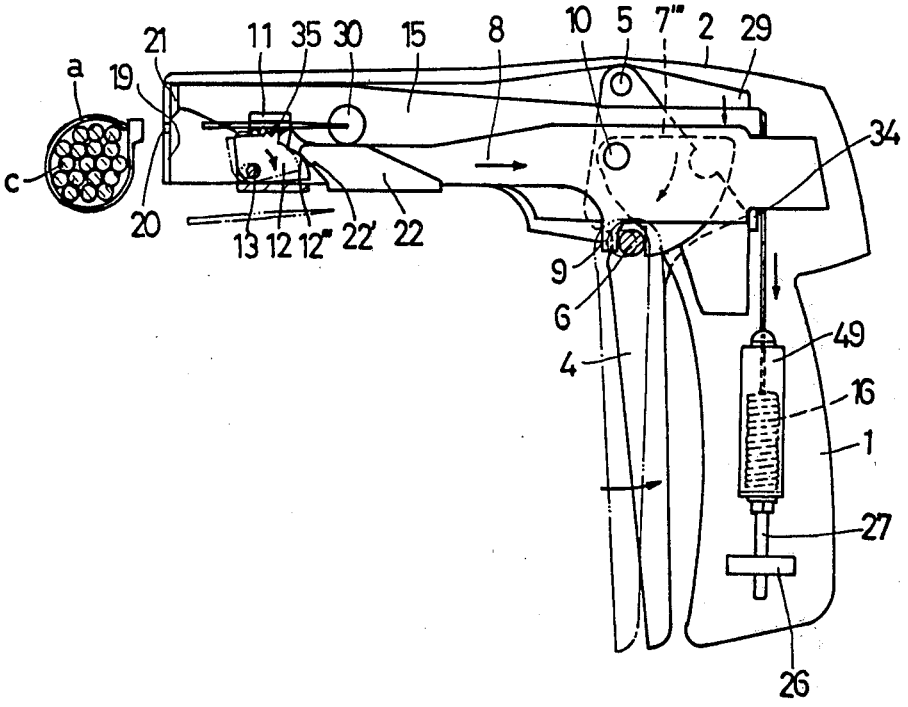
Figure 5:
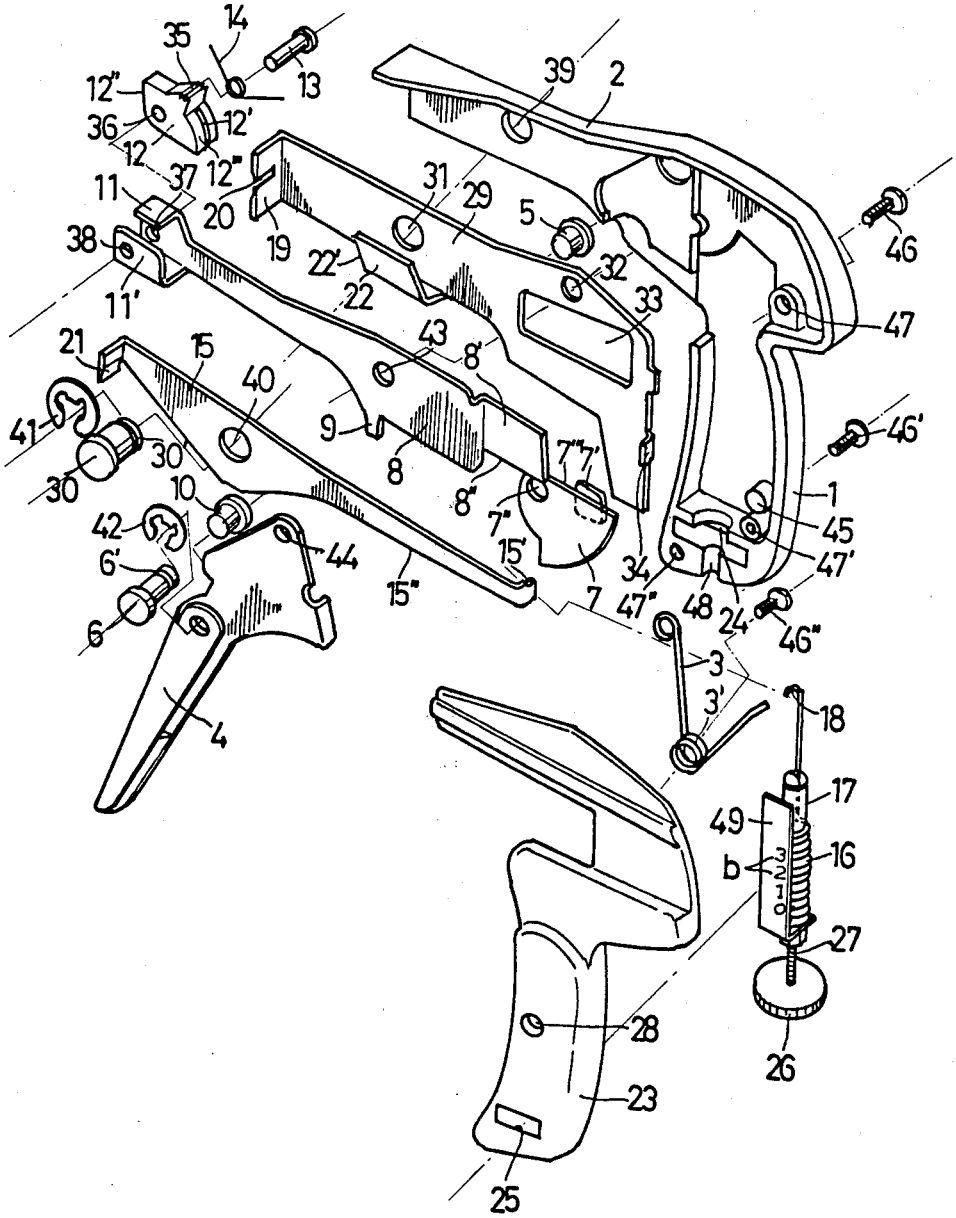
FIG. 5 is an exploded view of the components of the cutter.
Figure 6:
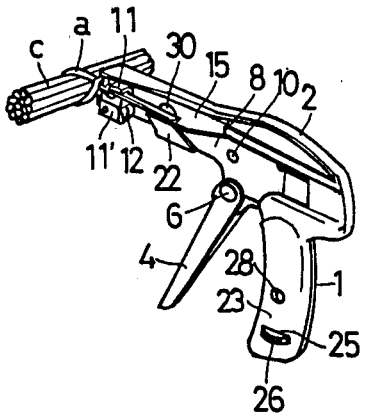
FIG. 6 is a perspective view showing a manner of use of the cutter.

As shown in FIG. 1, the end of the strap a winding up a bundle of cables c is pulled in through the slit 20 and when the handle 4 is pulled against the force of the formed wire spring 3 as shown in FIG. 2 the nipping member 12 that has been abutting against the bent part 19 is moved along with the movement of the sliding plate 8 so that the nipping teeth 35 will strongly nip the end of the strap a in cooperation with the bent part 11 under the action of the wire spring 14 to pull the strap rearwardly. Further pulling of the handle 4 will tension the strap a and when the fastening tightness has attained a certain strength, that is, when the fastening strength has become stronger than the force of the helical spring 16 the sliding plate 8 stops and the actuator member 7 is rotated by the pin 6 about the pin 10 as fulcrum (see FIG. 3). Accordingly, the cutter plate 15 is moved by the actuator member 7 about the pin 30 as fulcrum so that the cutting edge 21 comes down in this state to cut off the strap a. When the handle 4 is pulled further continuously it will cause the nipping member 12 to abut the cam 22 whereupon the teeth 35 will leave the strap a (refer to FIG. 4) so that the end portion of the strap a will fall off from the body. Thus, one performance of bundling electric cables and the like by the strap will be completed so that all the pertinent members may return to their original positions upon relief of the handle 4.

Figure 7:
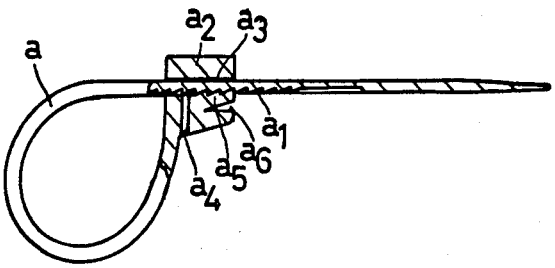
FIG. 7 is a longitudinal side sectional view of a strap.

As shown in FIG. 7, the binding strap a is provided with a non-return saw-toothed portion a1 and at the extended portion a2 of the base end of the strap there are formed a bore a3 and an engaging part a5 to engage with the saw-toothed portion a1 through a flat slit a4 which is perpendicular to and attaining the bore a3, a slit a6 being also formed therein to provide the engaging part a5 with elasticity in order to obtain complete securement after fastening.

When the handle once pulled is released, the pin 6 at the middle portion of the handle 4 moves forward resulting in that the upper edge 7″ of the actuator member also lowers simultaneously so that the cutter plate which has been forced up by the upper plate will also be lowered by the force of the helical spring 16, thereby the upper edge of the actuator member 7 will be pressed down by the slant bottom edge 15″ of the cutter plate and shifted simply rearwardly. And when the strap is fastened so firmly that the sliding plate 8 is stopped at a certain position, the pin also stops. When the gripping force is increased in that state, the pin 6 will move to retreat so that the actuator member 7 journalled on the pin 10 will make a circular motion so as to rotate upwardly, at the same time the upper edge 7″ of the actuator member 7 pushing upwardly the slant bottom edge 15″ of the cutter plate 15, the cutter plate 15 being kept lowered by the helical spring member 16 and top end hook 18.

If the adjusting member 17 were loaded with a 10 kg load for lowering its top end hook 18 it would be more difficult for the cutting edge 21 to be pressed down than when the member 17 were loaded with a 5 kg load. Similarly, it would be more difficult for the actuator member 7 to rotate when the adjusting member 17 is loaded with a 10 kg load than when the adjusting member 17 is loaded with a 5 kg load. Thus the actuator member will not rotate but will be continuously pulling the sliding plate 8 rearwardly by means of the pin 10. That is to say, if the tensioning strength of the helical spring 16 is set to be 10 kg, the sliding plate 8 will be able to tighten the bundle of wires with twice the force as compared with the case wherein the tensioning strength of the helical spring 16 is set to be 5 kg.

In the present invention, at the moment when the strap is cut, the sliding plate 8 is released from the stress which has been pulling the plate forward, and the sliding plate 8 is instantaneously shifted backward by means of the pin 10 which is actuated by the force of the helical spring 16 communicated through the contact of the upper edge 7″ of the actuator member 7 with the lower edge 15″ of the cutter plate 15. As a result the end of the strap is discharged so that each time one bundling is completed the next bundling can promptly be done, thereby remarkably increasing the operational efficiency.

Thus, in the present invention, the expected object is attained in a positive manner through the all-round cooperation of the components such as the sliding plate 8, actuator member 7 attached thereto by means of the pin, helical spring member acting to pull down the end of the cutter plate contacting the upper edge 7″ of the actuator member 7, and the handle contacting the actuator member through the pin. Furthermore, in using the present invention, it will be possible for operators, regardless of age or sex, to bundle wires and the like with a predetermined strength so that the tightness of fastening may always be constant, which presents another advantageous feature of the invention.

What is claimed is:

1. A tool for tensioning a bundling strap about a bundle of wires comprising:

a hollow body having an inner surface functioning as a first plate defining a major axis including a hollow grip dependent therefrom and integral therewith at a rear portion of said body;

a second plate attached adjacent said body including a forward bent portion having a strap insertion slit therein, and a rest cam at a middle portion thereof;

a third plate carried by said second plate, said third plate being supported on said rest cam for sliding motion relative thereto and along said major axis, said third plate including hook means at a forward end thereof normally positioned rearwardly of said second plate bent portion, and a return projection at a middle portion thereof;

a fourth plate pivotably mounted at a middle portion thereof to said body, the forward portion of said fourth plate including a cutting edge, said fourth plate being disposed adjacent said third plate with said cutting edge being located rearwardly of said second plate bent portion;

a nipping member pivotally carried by said third plate hook means and being biased toward said bent portion for coaction with said hook means to grasp said bundling strap therebetween;

a handle pivotably attached at its upper end to said body;

an actuator member engaging an intermediate portion of said handle, said actuator member being pivotally attached to said third plate with said return projection of said third plate being arranged for contacting said handle and said actuator member arranged for coaction with said fourth plate;

first spring means normally biasing said third plate forwardly and developing a predetermined first force;

second spring means having one end engaging the rear portion of said fourth plate, normally biasing said cutting edge into a raised position relative to said strap insertion slit in said second plate and normally developing a second predetermined force acting substantially normal to said first force;

so that upon insertion of a cable strap in said second plate slit and pivoting of said handle toward the grip of said body, the third plate slides rearwardly in opposition to said first predetermined force, and the nipping member rotates to hold the strap against the hook means and tighten it around the bundle of wire, so that when the strap is fully tightened aout the bundle, the third plate ceases its movement so that further pivoting of the handle causes the actuator to rotate into engagement with the fourth plate thereby causing the fourth plate to rotate against the second predetermined force until the cutting edge cuts the strap and releases the third plate for renewed rearward movement.

2. The tool of claim 1 wherein said second, third and fourth plates are disposed substantially parallel to said first plate hollow body and are aligned in the direction of said major axis.

3. The tool of claim 1 or 2 further including means for ejecting the cut end of said strap laterally from the tool, said ejecting means comprising:

the strap insertion slit disposed horizontally in said bent portion of said second plate and said strap being insertable into said slit from one side of said bent portion opposite said first plate; and said nipping member including a camming surface;

so that when the strap is cut by the cutting edge of the fourth plate and tension caused by the tightly held strap is released, the third plate is released for sliding movement rearwardly, and when the nipping member camming surface engages the rest cam of the second plate, it is cammed out of engagement with the strap, ejecting the strap substantially rearwardly and substantially laterally away from the body on said one side.

4. The tool of claim 1 or 2 wherein said second spring means comprises a spring, means for adjusting the tension in said spring, and a second end, said spring means second end being rotatable and retentatively positioned in said hollow grip.

5. The tool of claim 3 wherein said second spring means comprises a spring, means for adjusting the tension in said spring, and a second end, said spring means second end being rotatable and retentatively positioned in said hollow grip.

* * * * *

Disclaimer and Dedication 4,390,047.—*Hogara Kaneko,* Fujisawa, Japan. TOOL FOR STRAP TENSIONING AND CUTTING. Patent dated June 28, 1983. Disclaimer and Dedication filed Dec. 15, 1983, by the inventor.

Hereby disclaims and dedicates all claims of said patent.

[*Official Gazette February 21, 1984.*]